US011817662B2

(12) United States Patent
Navarro

(10) Patent No.: US 11,817,662 B2
(45) Date of Patent: Nov. 14, 2023

(54) ROTATABLE POWER STRIP OUTLET ASSEMBLY

(71) Applicant: Luis Navarro, Miami, FL (US)

(72) Inventor: Luis Navarro, Miami, FL (US)

( * ) Notice: Subject to any disclaimer, the term of this patent is extended or adjusted under 35 U.S.C. 154(b) by 60 days.

(21) Appl. No.: 17/687,305

(22) Filed: Mar. 4, 2022

(65) Prior Publication Data

US 2023/0283031 A1 Sep. 7, 2023

(51) Int. Cl.

| | |
|---|---|
| ***H01R 13/33*** | (2006.01) |
| ***H01R 35/04*** | (2006.01) |
| ***H01R 25/00*** | (2006.01) |
| ***H01R 13/627*** | (2006.01) |
| *H01R 103/00* | (2006.01) |

(52) U.S. Cl.

CPC ..... *H01R 35/04* (2013.01); *H01R 13/33* (2013.01); *H01R 13/6271* (2013.01); *H01R 25/006* (2013.01); *H01R 2103/00* (2013.01)

(58) Field of Classification Search

None

See application file for complete search history.

(56) References Cited

U.S. PATENT DOCUMENTS

| | | | | |
|---|---|---|---|---|
| 4,753,600 | A | 6/1988 | Williams | |
| 5,759,051 | A | 6/1998 | Cancellieri et al. | |
| 6,196,851 | B1 | 3/2001 | Gerard et al. | |
| 6,750,410 | B2 | 6/2004 | Lee | |
| 7,238,028 | B2 | 7/2007 | Gerard | |
| 7,500,854 | B2 | 3/2009 | Gottstein | |
| 7,510,420 | B2 | 3/2009 | Mori | |
| 8,118,616 | B1 | 2/2012 | Clark | |
| 8,210,853 | B2 | 7/2012 | Gerard | |
| 8,262,399 | B1 | 9/2012 | Zien et al. | |
| 8,430,679 | B1 | 4/2013 | Long et al. | |
| 8,469,730 | B2 * | 6/2013 | Garb | H01R 31/065 439/166 |
| 8,500,492 | B2 * | 8/2013 | Brown | H01R 31/005 439/638 |
| 9,004,930 | B2 | 4/2015 | Gualino et al. | |
| 9,028,274 | B2 * | 5/2015 | Zien | H01R 29/00 439/527 |
| 9,190,785 | B1 * | 11/2015 | Rogero | H01R 35/04 |
| 9,698,550 | B2 | 7/2017 | Byrne et al. | |
| 9,859,670 | B1 | 1/2018 | Liao | |
| 10,033,144 | B1 | 7/2018 | Patterson | |
| 10,608,395 | B1 | 3/2020 | Chen | |

* cited by examiner

*Primary Examiner* — Tho D Ta

(74) *Attorney, Agent, or Firm* — Mark C. Johnson; Johnson Dalal

(57) ABSTRACT

A rotatable power strip outlet assembly that includes a power strip housing, a plurality of electrical sockets formed on a front surface of the power strip housing, and a rear plug support member rotatably coupled to the power strip housing, that includes a front surface, a rear surface, and an electrical plug disposed on the rear surface of the rear plug support member and with electrical prongs extending outwardly away from the rear surface of the rear plug support member and electrically coupled to the plurality of electrical sockets, wherein the power strip housing is operably configured to selectively rotate at least 270° with respect to the rear plug support member to reorient the power strip housing while plugged into an electrical outlet.

19 Claims, 9 Drawing Sheets

ROTATABLE POWER STRIP OUTLET ASSEMBLY

FIELD OF THE INVENTION

The present invention relates generally to electrical outlets and, more particularly, relates to a power strip outlet assembly operably configured to be rotatable.

BACKGROUND OF THE INVENTION

An electrical outlet is a socket that connects an electrical device to a supply of electricity, albeit directly or indirectly. Most electrical sockets are installed in the wall, or floor, or even ceiling. Some power cords terminate at a plug that typically mates with an electrical socket. The power cord temporarily connects an electrical device to the electrical socket, so as to supply a current and power thereto. In most electrical outlets, namely those that are attached to a wall, the female electrical sockets are oriented in a fixed position. This fixed orientation reduces the flexibility of the electrical outlet. A "power strip" is also commonly referred to an extension block, extension box, power board, power bar, plug board, pivot plug, trailing gang, trailing socket, plug bar, trailer lead, multiple socket, multi-socket, multiplug, multigang, multi-box, multibox, socket board, super plug, multiple outlet, polysocket and by many other variations), but is generally considered a block of electrical sockets that attach to the end of a flexible cable (typically with a mains plug on the other end), allowing multiple electrical devices to be powered from a single electrical socket. Power strips are often used when many electrical devices are in proximity, such as for audio, video, computer systems, appliances, power tools, and lighting. Power strips often include a circuit breaker to interrupt the electric current in case of an overload or a short circuit. Some power strips provide protection against electrical power surges. Typical housing styles include strip, rack-mount, under-monitor and direct plug-in, but most known power strips are unable to be rotated or configured effectively and efficiently for many users' specifications or design applications.

Therefore, a need exists to overcome the problems with the prior art as discussed above.

SUMMARY OF THE INVENTION

The invention provides a rotatably power strip outlet assembly that overcomes the hereinafore-mentioned disadvantages of the heretofore-known devices and methods of this general type and that enables users to couple a power strip to a wall outlet and rotate (and lock) the power strip in various angular positions while connected to the wall outlet.

With the foregoing and other objects in view, there is provided, in accordance with the invention, a rotatable power strip outlet assembly having a power strip housing with a rear surface, a front surface opposing the rear surface of the power strip housing, and encapsulating a housing cavity, a plurality of electrical sockets formed on the front surface of the power strip housing and each at least partially disposed within the housing cavity, and a rear plug support member rotatably coupled to the power strip housing, having a front surface, having a rear surface opposing the front surface of the rear plug support member, and having an electrical plug disposed on the rear surface of the rear plug support member and with electrical prongs extending outwardly away from the rear surface of the rear plug support member and electrically coupled to the plurality of electrical sockets. The power strip housing is operably configured to selectively rotate at least 270° with respect to the rear plug support member.

In accordance with another feature, an embodiment of the present invention includes a rear support spindle operably configured to couple the plug support member to the power strip housing and an electrical connector defined by the power strip housing and axially aligned with the rear support spindle, wherein the electrical connector is operably configured to enable electrical coupling of the electrical prongs to the plurality of electrical sockets.

In accordance with yet another feature, an embodiment of the present invention also includes the electrical connector being a wire aperture and having a plurality of electrical wires electrically coupling the electrical prongs to the plurality of electrical sockets and disposed within the wire aperture.

In accordance with a further feature, an embodiment of the present invention also includes a ratchet gear and pawl assembly operably coupled to the rear surface of the power strip housing and the rear surface of the rear plug support member, wherein the ratchet gear and pawl assembly is operably configured to enable the power strip housing to selectively rotate the at least 270° and in a plurality of locked angular positions with respect to the rear plug support member.

In accordance with an additional feature, an embodiment of the present invention also includes a sidewall surrounding the rear surface of the rear plug support member and with an inner sidewall surface having at least one pawl member projecting therefrom and a ratchet gear of the ratchet gear and pawl assembly coupled to the rear surface of the power strip housing and operably coupled with the at least one pawl member to enable the power strip housing to selectively rotate in the plurality of locked angular positions with respect to the rear plug support member.

In accordance with a further feature of the present invention, the ratchet gear is operably coupled with the at least one pawl member to enable the power strip housing to selectively rotate at least 360° and with the plurality of locked angular positions solely lockable in one direction of rotation.

In accordance with yet another feature, an embodiment of the present invention also includes a circular housing recess defined by opposing inner walls of the power strip housing and the rear surface of the rear power strip housing and the rear plug support member of a circular shape and disposed within the circular housing recess, wherein the circular shape of the rear plug support member is contouring a shape of the opposing inner walls of the power strip housing.

In accordance with a further feature, an embodiment of the present invention also includes the rear plug support member with a retention flange member radially extending therefrom and defining a retention aperture thereon and with a fastener operably configured to be received therethrough. The retention flange member is disposed proximal to the rear surface of the rear plug support member, wherein the power strip housing operably configured to selectively rotate with respect to the rear plug support member and have a rotation position along a housing rotation path with the rear surface of the power strip housing in at least a partially overlapping and adjacent configuration with the retention flange member.

In accordance with yet another feature, an embodiment of the present invention also includes the power strip housing having a plurality of socket apertures independently defined thereon and each having one of a plurality of socket housings disposed therein. The plurality of socket housings each are at least partially disposed within the housing cavity, each retained on the power strip housing with at least one spring-loaded clip, and define the plurality of electrical sockets formed on the front surface of the power strip housing.

In accordance with a further feature of the present invention, the plurality of socket housings are each coupled to the power strip housing in a tongue-and-groove configuration on two opposing sides of the plurality of socket housings.

In accordance with an additional feature, an embodiment of the present invention also includes the power strip housing having a first end, a second end opposing the first end of the power strip housing, a housing length separating the first and second ends of the power strip housing, and a sidewall surrounding the housing cavity and including an LED strip coupled thereto, spanning at least 75% of the housing length, longitudinally oriented, and electrically connected to a driver and the electrical prongs.

Although the invention is illustrated and described herein as embodied in a rotatably power strip outlet, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the power strip housing or in a direction spanning from the first end of the power strip housing to the second end of the power strip housing. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
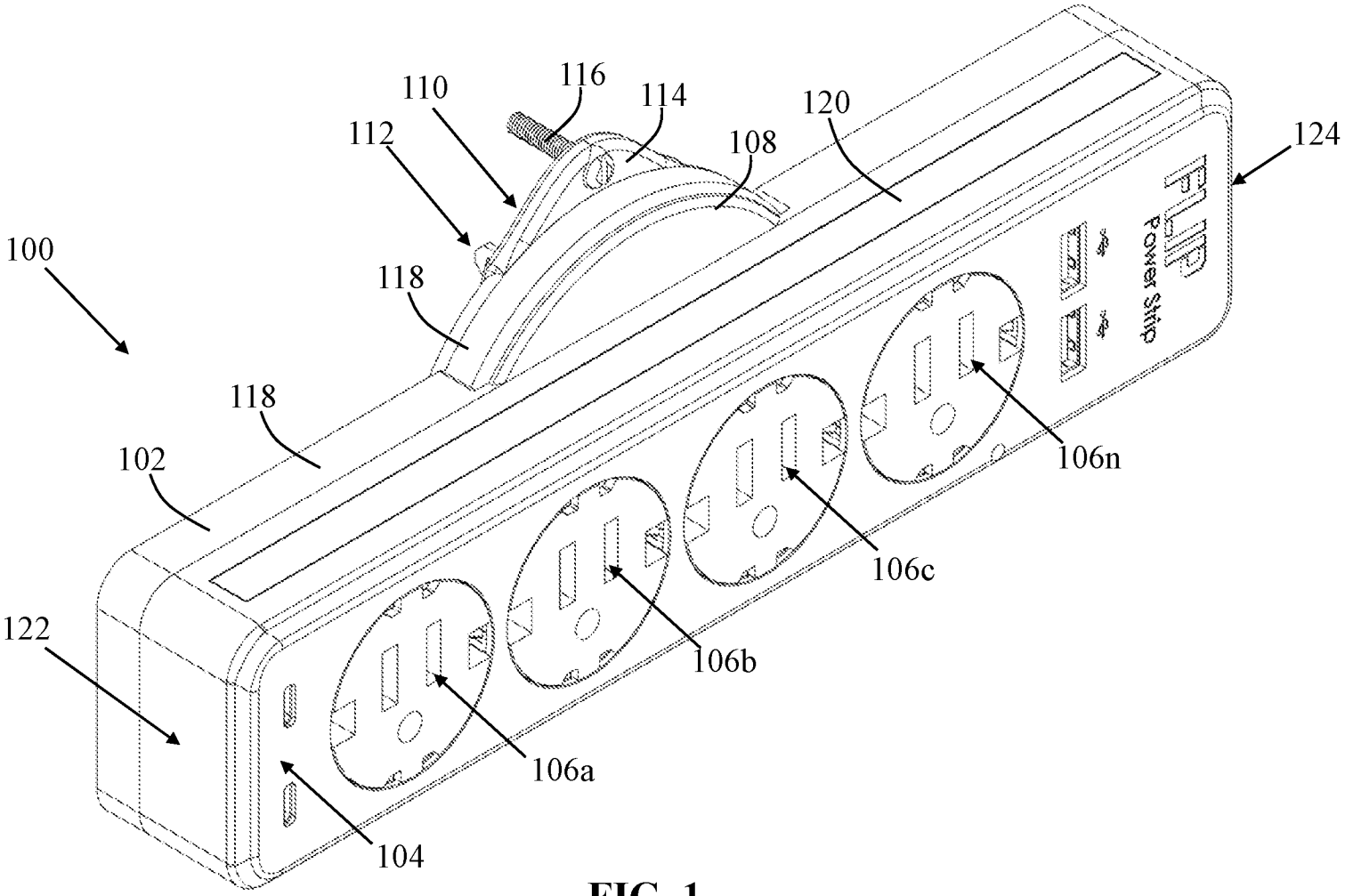
FIG. 1 is a front perspective view of a rotatable power strip outlet assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient rotatably power strip outlet that includes a power strip housing that is operably configured to selectively rotate at least 270°, but preferably 360°, with respect to a rear plug support member having electrical prongs configured to be received in an wall or other electrical outlet, thereby enabling a user to rotate and reorient the power strip housing while plugged into the electrical wall outlet.

Figure 2:
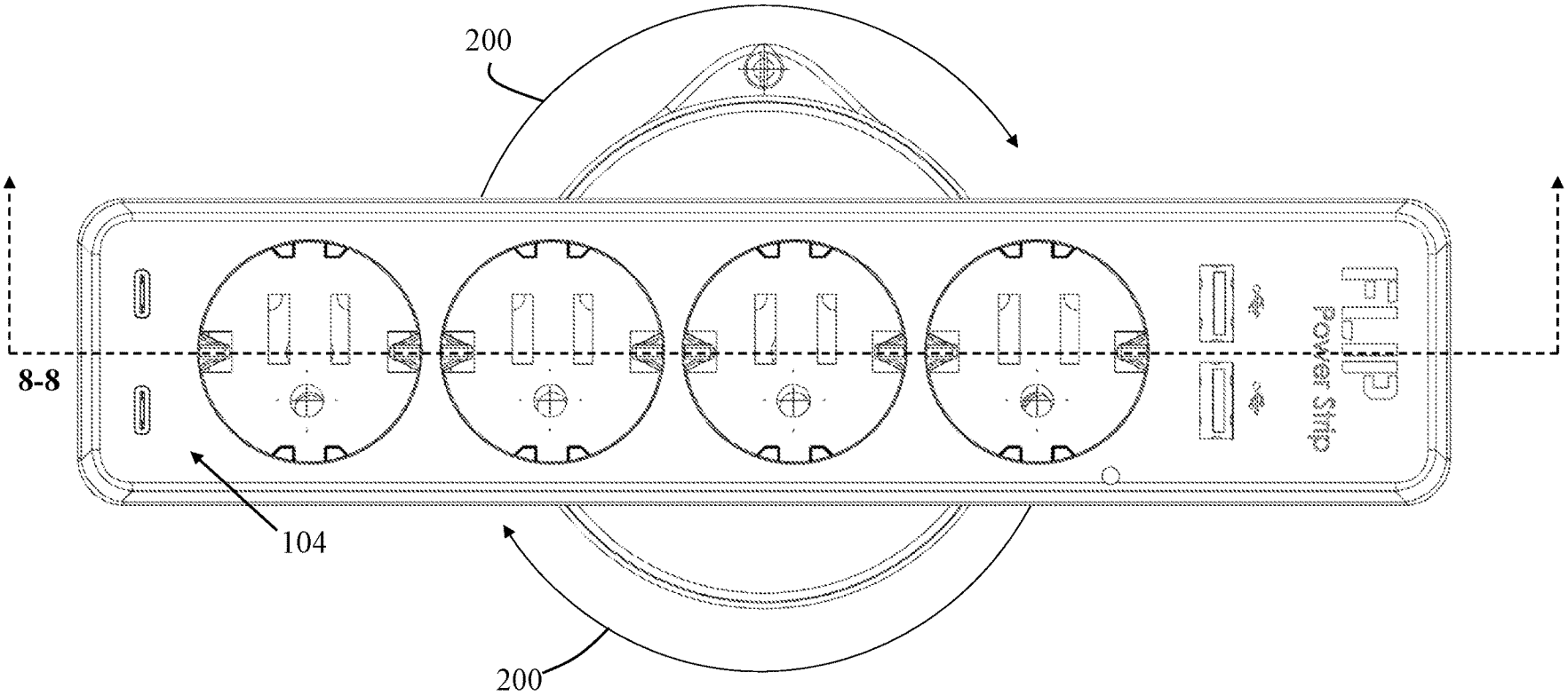
FIG. 2 is an elevational front view of the rotatable power strip outlet assembly depicted in FIG. 1.
Figure 4:
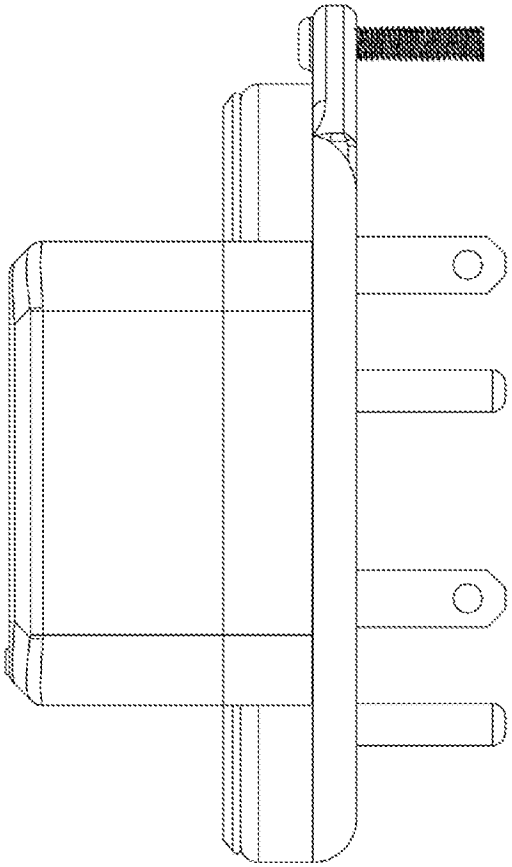
FIGS. 3-4 are elevational left-side and right-side views, respectively, of the rotatable power strip outlet assembly depicted in FIG. 1.
Figure 3:
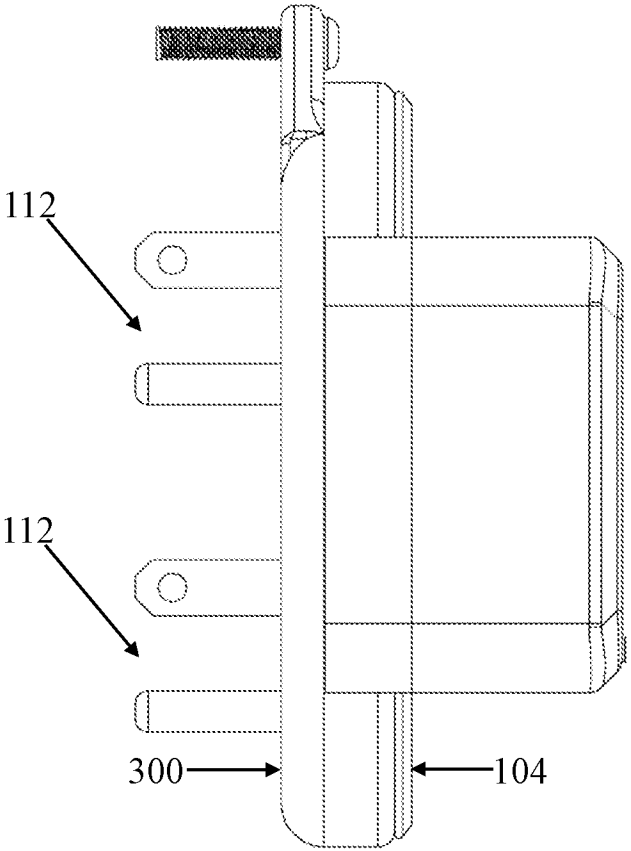
Figure 7:
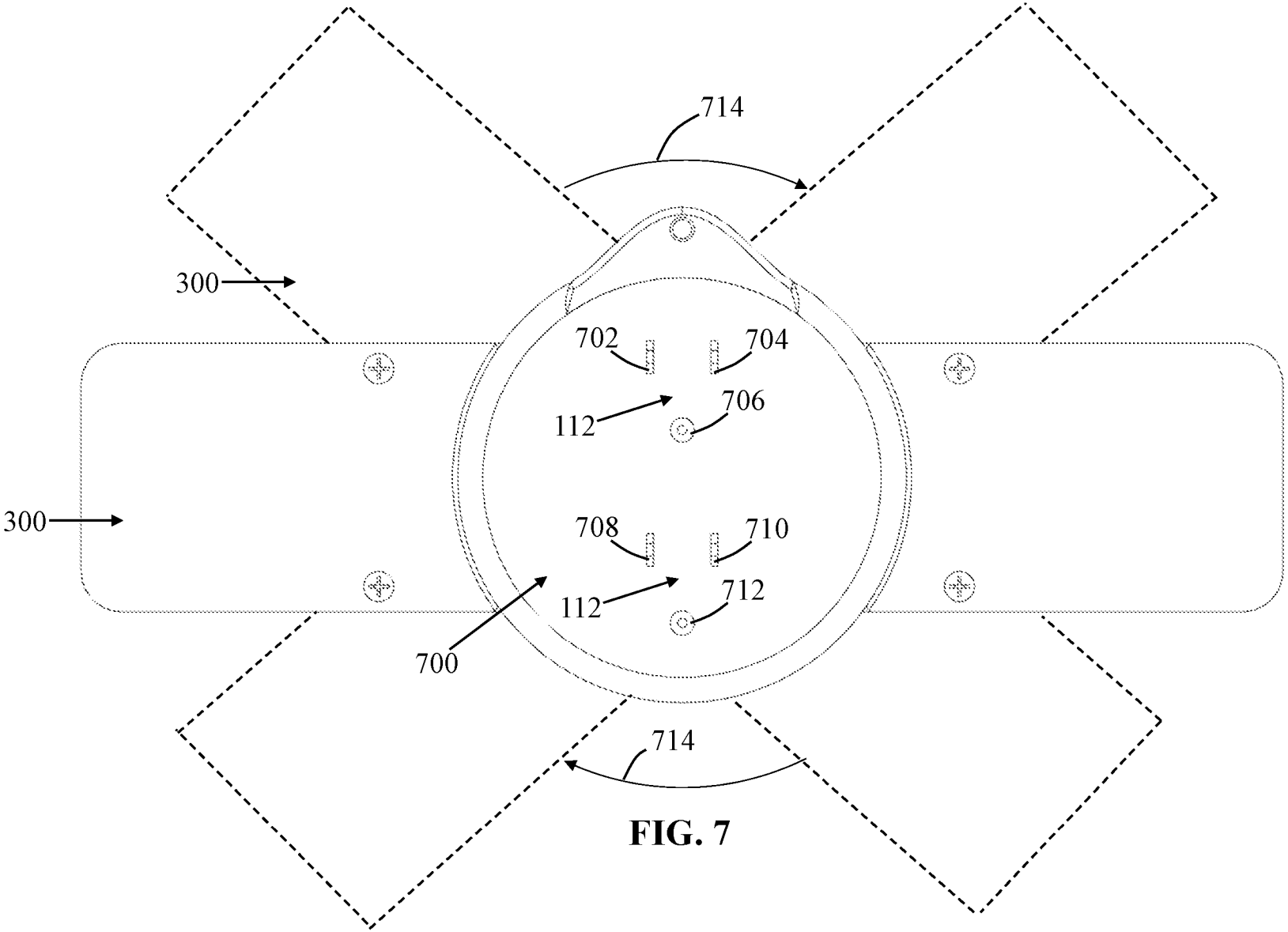
FIG. 7 is an elevational rear view of the rotatable power strip outlet assembly depicted in FIG. 1.

Referring now to FIGS. 1-2 and FIG. 7, one embodiment of the present invention is shown in a perspective view. The figures herein show several advantageous features of the present invention, but, as will be described below, the invention can be provided in several shapes, sizes, combinations of features and components, and varying numbers and functions of the components. The first example of a rotatable power strip outlet assembly 100, as shown in FIG. 1 and the other figures, includes a power strip housing 102, a plurality of electrical sockets 106*a-n*, and a rear plug support member 108, wherein "n" represents any number greater than one. The power strip housing 102 may be of a substantially rigid and electrically resistive material, e.g., PVC, ABS, etc. and is beneficially formed with two or more pieces to encapsulate or define a housing cavity 902 where components are housed. The power strip housing 102 may also be formed with one or more pieces that are injection molded or cast. Beneficially, however, the power strip housing 102 does not have any power cord and is operable to couple with one or more electrical outlets on a wall or other structure, while simultaneously enabling the user to rotate the power strip housing 102 to a desired orientation and angular position along a housing rotation path housing rotation path (represented with arrows 200, 714 in FIG. 2 and FIG. 7, respectively).

Figure 5:
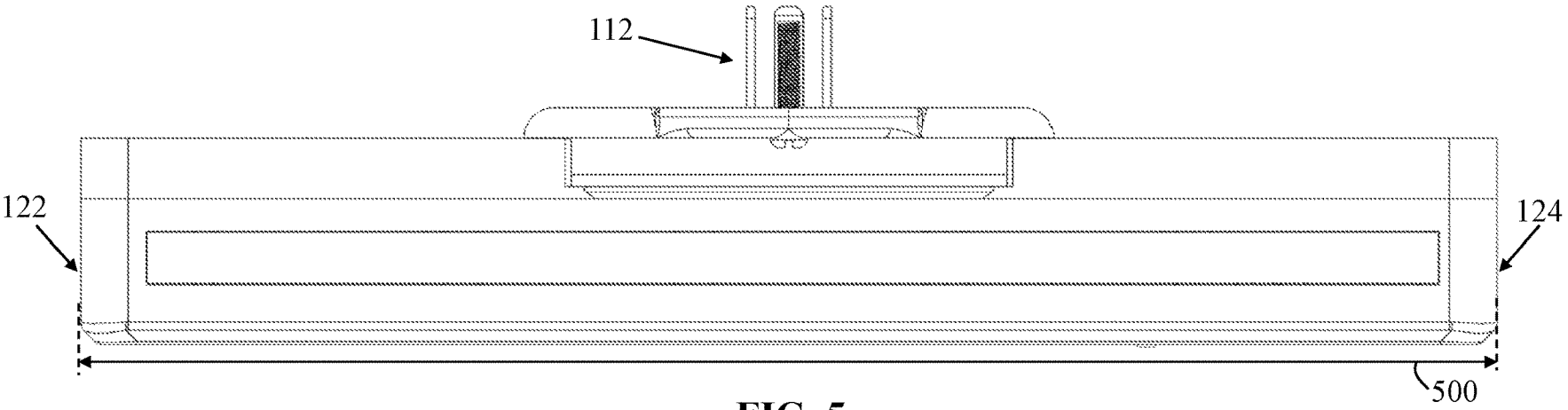
FIGS. 5-6 are top and bottom plan views, respectively, of the rotatable power strip outlet assembly depicted in FIG. 1.
Figure 6:
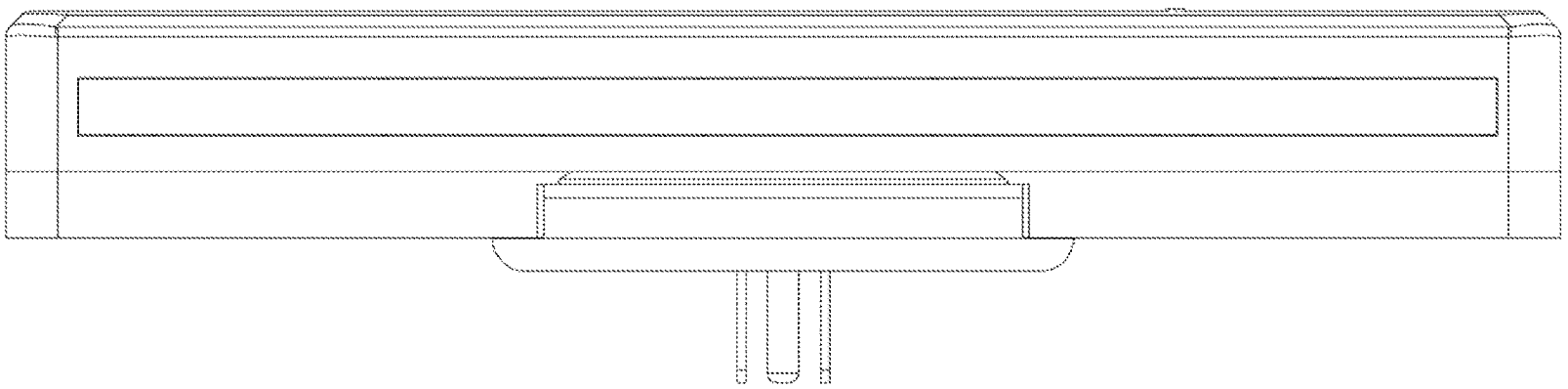

The power strip housing 102 also has a rear surface 300, a front surface 104 opposing the rear surface 300 of the power strip housing 102, a first end 122, a second end 124 opposing the first end 122 of the power strip housing 102, and, with reference to FIG. 5, a housing length 500 separating the first and second ends of the power strip housing 102. The housing length 500 may be approximately 9-10 inches in length, may be approximately 1-3 inches separating the rear and front surfaces 300, 104 of the power strip housing 102, and approximately 2-3 inches separating the surface that defines the plurality of electrical sockets 106*a-n*. It should be understood that terms such as, "front," "rear," "side," top," "bottom," and the like are indicated from the reference point of a viewer viewing the power strip housing 102 or other referencing structure, typically when installed or coupled to an electrical outlet.

Figure 9:
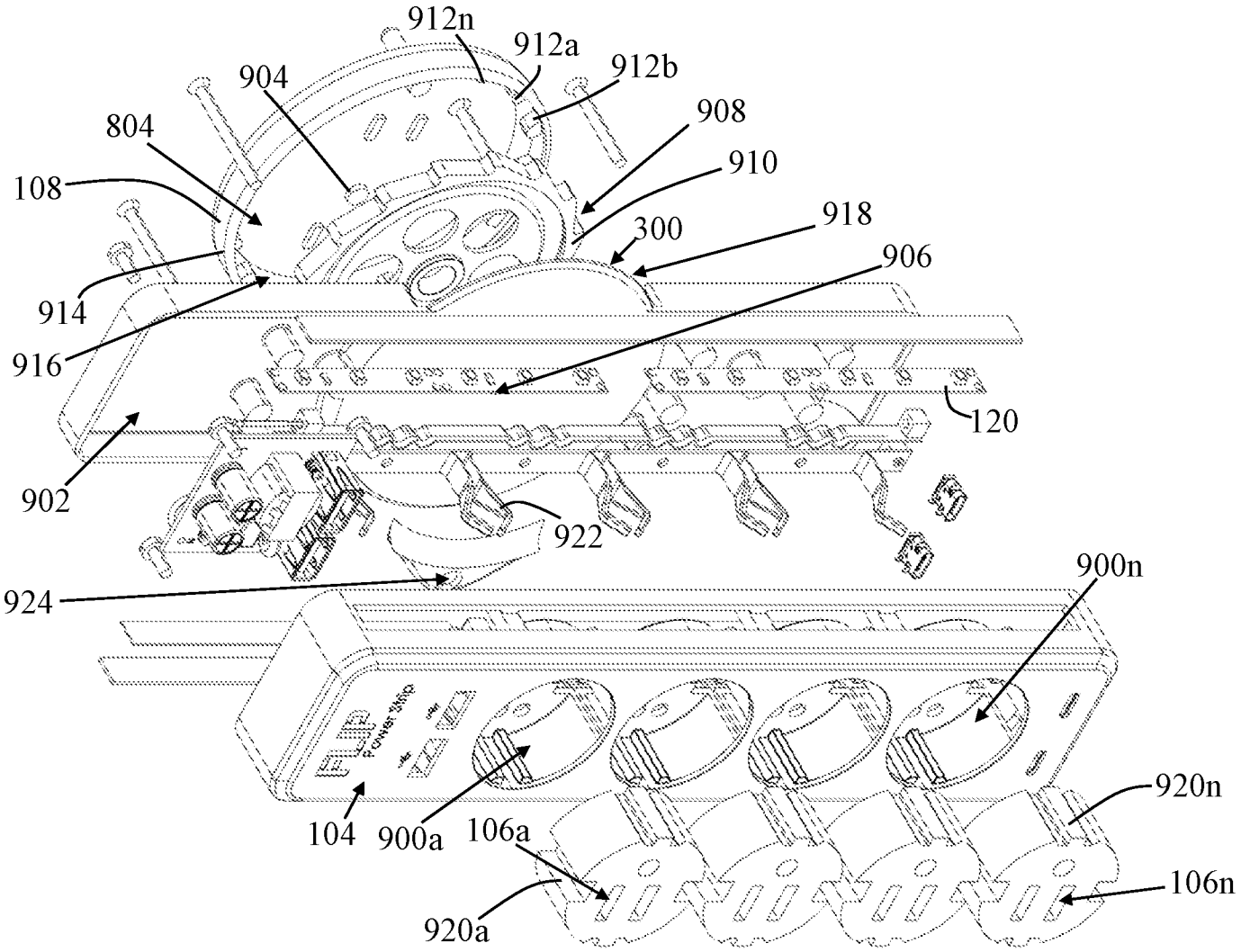
FIG. 9 is an exploded view of the rotatable power strip outlet assembly depicted in FIG. 1 in accordance with an exemplary embodiment of the present invention.
Figure 10:
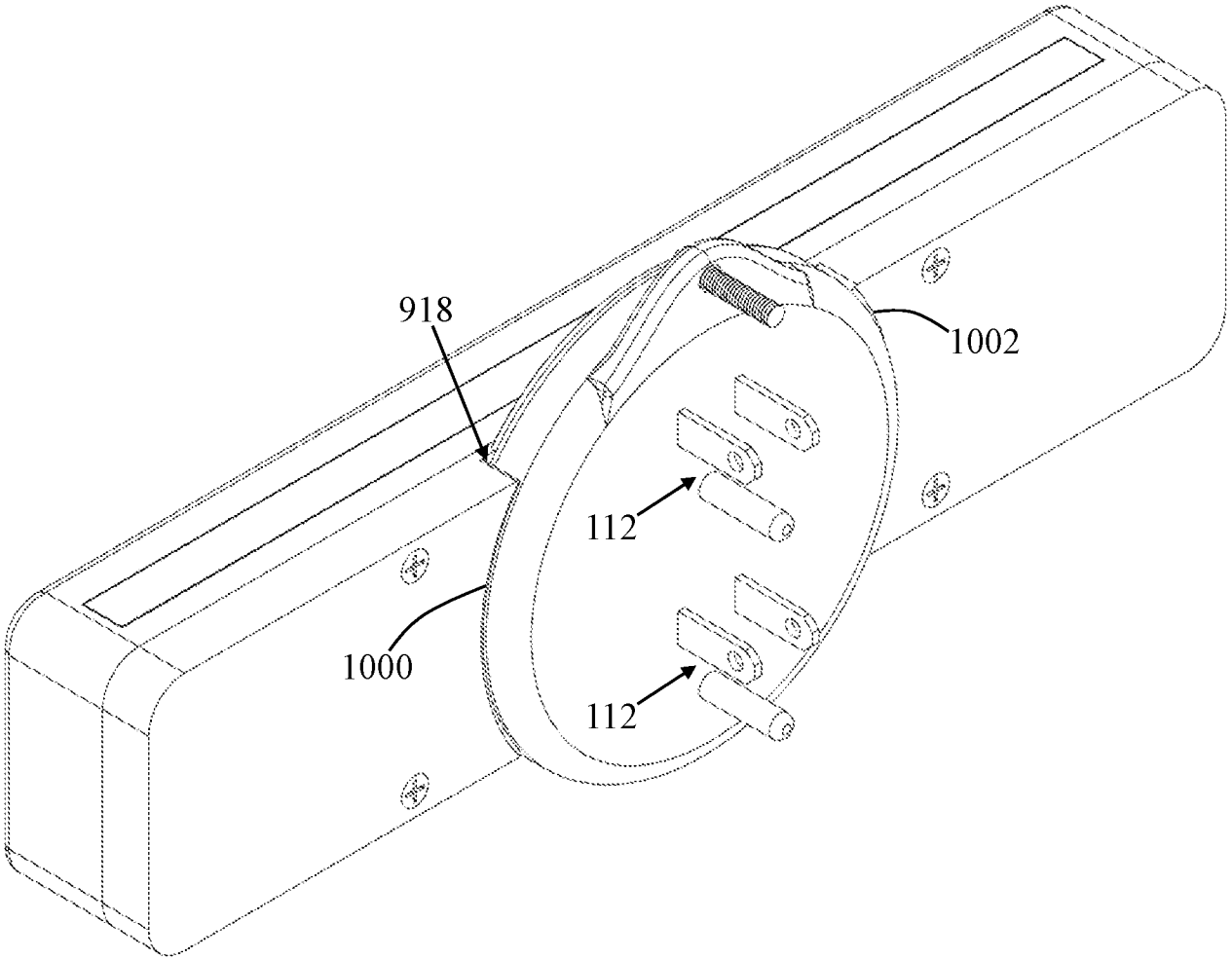
FIG. 10 is a rear perspective view of the rotatable power strip outlet assembly depicted in FIG. 1.

With reference to FIG. 1 and FIG. 9, the power strip housing 102 includes a plurality of electrical sockets 106*a-n* formed on the front surface 104 of the power strip housing 102, wherein each are at least partially disposed within the housing cavity 902. In one embodiment, the electrical sockets 106*a-n* are integrally formed in and by the power strip housing 102 and includes the required electrical contacts to transfer energy, e.g., a live/hot, neutral, and earth/ground contact. In another embodiment, the power strip housing 102 defines a plurality of socket apertures 900*a-n* independently defined thereon, i.e., the socket apertures 900*a-n* are enclosed or defined apertures on the power strip housing 102. Each of the socket apertures 900*a-n* has one of a plurality of socket housings 920*a-n* disposed therein.

Figure 8:
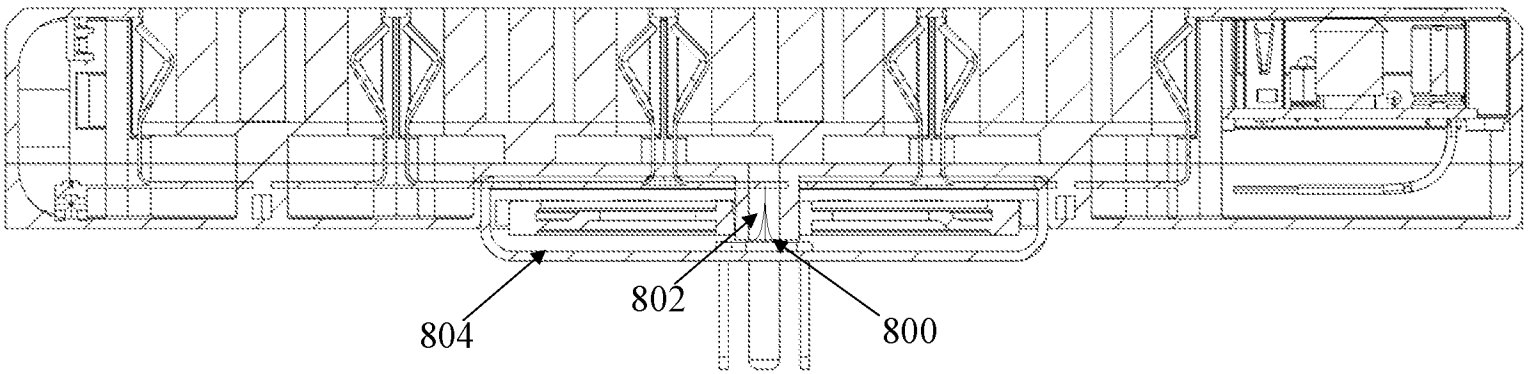
FIG. 8 is a cross-sectional view of the rotatable power strip outlet assembly depicted in FIG. 2 along section line 8-8 in accordance with an exemplary embodiment of the present invention.

The plurality of socket housings 920*a-n* are each at least partially disposed within the housing cavity 902 and may be fully disposed within the housing cavity 901. The plurality of socket housings 920*a-n* are also each retained on the power strip housing 102 with, for example, at least one spring-loaded clip 922 and define the plurality of electrical sockets 106*a-n* formed on the front surface 104 of the power strip housing 102. As seen in FIG. 8 as well, each of the socket housings 920*a-n* may include a channel formed therein that is shaped and sized to receive the spring-loaded clip 922, wherein the clip 922 inhibits or prevents the socket housings 920*a-n* from being easily pulled out of the power strip housing 102.

In another embodiment, the socket housings 920*a-n* may be adhesively coupled to the power strip housing 102 as well. In one embodiment, the plurality of socket housings 920*a-n* are each coupled to the power strip housing 102, namely the inner sidewalls thereon, in a tongue-and-groove configuration on two opposing sides of the plurality of socket housings 920. Said another way, the tongue-and-groove configuration may be a male-female coupling configuration or other coupling configuration that The tongue-and-groove configuration between the socket housings 920*a-n* and the power strip housing 102 inhibits or prevents rotational movement of the socket housings 920*a-n*.

The power strip housing 102 may also include a circuit breaker for overload protection and against short circuits by automatically cutting off the power supply when the total current of connected devices exceeds a set amperage, e.g., 15A. Each of the plurality of electrical sockets 106*a-n* may be 3-prong alternating current (AC) outlets.

With reference to FIG. 1, FIG. 7, and FIGS. 8-9, the rear plug support member 108 can be seen rotatably coupled to the power strip housing 102 using, for example, a centrally located spindle, or rear support spindle 904. This selective rotation enables the user to position the power strip housing 102 in a desired orientation. The rear plug support member 108 may be of a monolithic structure or may be comprised with multiple components. The rear plug support member 108 has a front surface 804, a rear surface 110 opposing the front surface 804 of the rear plug support member 108, and an electrical plug 112 disposed on the rear surface 110 of the rear plug support member 108 and with electrical prongs, e.g., prongs 702, 704, 706, 708, 710, 712, extending outwardly away from the rear surface 110 of the rear plug support member 108. The amount and configuration of electrical prongs are configured for insertion into conventional wall outlets. The electrical prongs are electrically coupled to the plurality of electrical sockets 106*a-n* using, for example, wiring 800. Beneficially, the power strip housing 102 is operably configured to selectively rotate at least 270° with respect to the rear plug support member 108.

To effectuate the rotation described herein, a rear support spindle 904 may be utilized and that is operably configured to couple the plug support member 108 to the power strip housing 102. The rear support spindle 904 may be coupled to the front surface 804 of the rear plug support member 108 and/or the rear surface 300 of the power strip housing 102. The rear support spindle 904 may serve as the support and axis of rotation for the power strip housing 102 and, as best seen in FIG. 9, be formed with a key or a spline shaped and sized to be received within a keyway or recess formed in a gear 910. The rear support spindle 904 may include a spring operably coupled thereto and retained by a flange that retains the power strip housing 102 to the plug support member 108.

The spring may also enable the user to pull back the power strip housing 102 to disengage the gear 910 from one or more pawl members 912*a-n* utilized by the assembly 100. Further, the rear support spindle 904 may also include an internal channel formed thereon for enabling the wiring 802 to pass therethrough.

Figure 11:
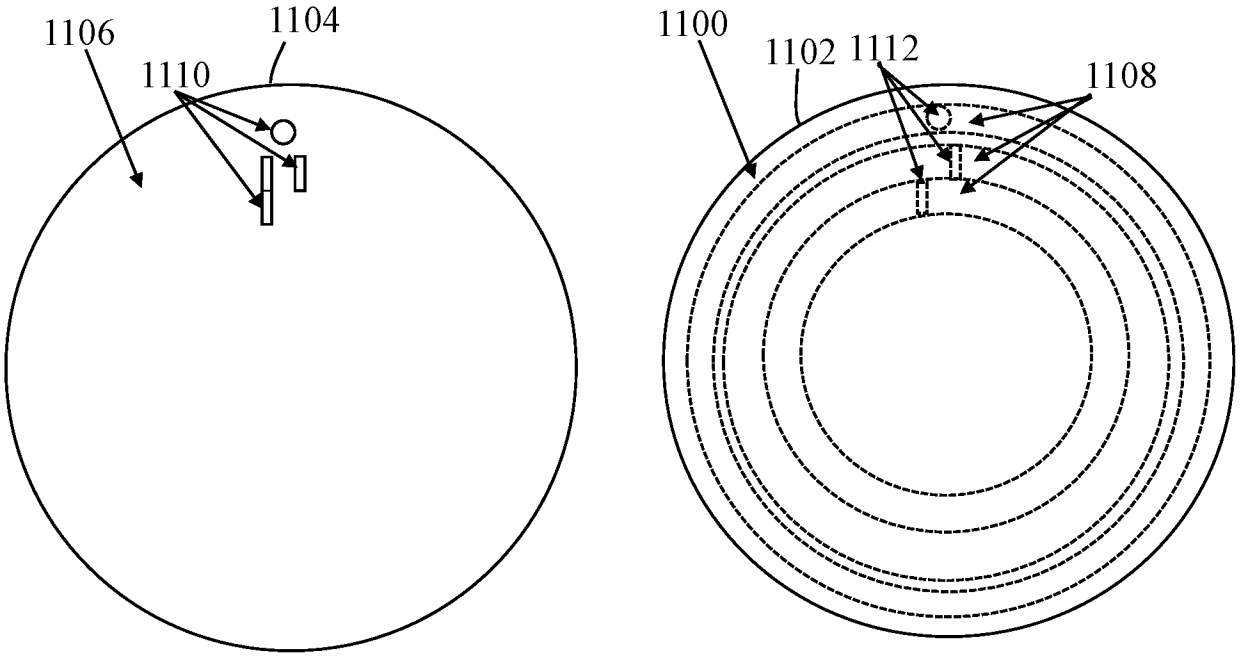
FIG. 11 depicts overhead and fragmentary plan views of a rear surface of the power strip housing and a front surface of a rear plug support member in accordance with one embodiment of the present invention.

In one embodiment, an electrical connector 906 is defined by the power strip housing 102 and is axially aligned with the rear support spindle 904. The electrical connector 906 is operably configured to enable electrical coupling of the electrical prongs to the plurality of electrical sockets 106*a-n*. To that end, the electrical connector 906 may be a wire aperture 802 shaped and sized to receive wiring (neutral, active/hot, and/or ground) or concentrically aligned electrically circles with metallic contacts forming the same (as depicted in FIG. 11 and described further herein). In other embodiments, the electrical connector 906 is an electrically conductive material that enables the electric communication between the electrical prongs and the plurality of electrical sockets 106*a-n*.

In preferred embodiments, however, the electrical connector 906 is a wire aperture 802 that includes a plurality of electrical wires 800 disposed therein and electrically coupling the electrical prongs to the plurality of electrical sockets 106*a-n* and disposed within the wire aperture 802. To further enable the electrical coupling, the assembly 100 may also include a busbar disposed within the housing cavity 902.

To effectuate the rotation of the power strip housing 102, a ratchet gear and pawl assembly 908 is utilized and is operably coupled to the rear surface 300 of the power strip housing 102 and the rear surface 804 of the rear plug support member 108. Said another way, the ratchet gear and pawl assembly 908 is coupled to the power strip housing 102 and the rear plug support member 108 to enable the power strip housing 102 to rotate in various positions (exemplified in FIG. 7 with fantom lines for the power strip housing 102). The ratchet gear and pawl assembly 908 is operably configured to enable the power strip housing 102 to selectively rotate the at least 270°, but preferably 360°, and in a plurality of locked angular positions (exemplified in FIG. 7) with respect to the rear plug support member 108.

In one embodiment, the power strip housing 102 and/or the rear plug support member 108 has a rotation limiter, e.g., a structure that prevents movement passed a desired angle of rotation, e.g., 360°. The rotation limiter would prevent or inhibit the power strip housing 102 from being over-rotated and potentially damaging the wiring connection between the electrical prongs and the plurality of electrical sockets 106*a-n*. In some embodiments, the power strip housing 102 may be operable to rotate in excess of 360°. In some embodiments, a sidewall 914 of the rear plug support member 108 is utilized to cover ratchet gear and pawl assembly 908 and to surrounds the rear surface 804 of the rear plug support member 108. The sidewall 914 may include an inner sidewall surface 916 with one or more pawl member 912*a-n* projecting therefrom. The ratchet gear and pawl assembly 908 includes a ratchet gear 910 that may be coupled to the rear surface 300 of the power strip housing 102 and is operably coupled with the at least one pawl member 912*a-n* to enable the power strip housing 102 to selectively rotate in the plurality of locked angular positions with respect to the rear plug support member 108. Said another way, the one or more pawl members 912*a-n* prevent rotation of the power strip housing 102 in one direction of rotation. In one embodiment, the at least one pawl member 912*a-n* are integrally formed with the rear plug support member 108, whether on the sidewall 914 or the front surface 804. In other embodiments, the at least one pawl member 912*a-n* may be selectively movable to engage or disengage with the ratchet gear 910. As used herein, the term "wall" is intended broadly to encompass continuous structures, as well as, separate structures that are coupled together so as to form a substantially continuous external surface. In some embodiments, the assembly 100 may include a safety lock that also prevents rotation in the direction opposite inhibited by the pawl member(s) 912*a-n*.

With reference briefly to FIG. 11, overhead and fragmentary plan views of a rear surface 1100 of a power strip housing 1102, namely the surface that is defined and configured to receive a rear plug support member 1104, and a front surface 1106 of the rear plug support member 1104. As discussed above, the assembly 100 may utilize wiring 800 to provide electrical connection between the electrical plug 112 disposed on the rear surface 110 of the rear plug support member 108 and the plurality of electrical sockets 106*a-n*. In another embodiment, the electrical connection is provided through utilization of electrically conductive rails or paths 1108 defined by the rear surface 1100 of the power strip housing 1102 and specially configured electrically conductive prongs 1110 operably configured to engage or contact with the rails or paths 1108 when the power strip housing 1102 and rear plug support member 1104 are coupled together.

As shown, each of the electrically conductive prongs 1110 correspond to and are independently electrically connected to the one or more electrical prongs 702, 704, 706, 708, 710, 712 utilized by the rear plug support member 1104. As the power strip housing 1102 is configured to rotate with respect to the rear plug support member 1104, the configuration and coupling of the electrically conductive prongs 1110 and electrically conductive rails or paths 1108 enables the electrical connectivity while the power strip housing 1102 is being rotated and/or when it is locked in the desired angular position. To accomplish the same and prohibit overlap in electrical connection, each of the electrically conductive prongs 1110 will have their own independent path of rotation and may be staggered in position (as shown in the figures) to accomplish the same. Fantom lines 1112 represent where the electrically conductive prongs 1110 would be located on the rails or paths 1108 when the power strip housing 1102 and rear plug support member 1104 are coupled together. As such, it can be seen that 360° rotation and electrically connectivity can be accomplished with the concentrically located rails or paths 1108. To ensure connectivity, a tongue-and-groove configuration and/or materials for the rails or paths 1108 and electrically conductive prongs 1110 that are dipolar may be beneficially utilized.

With reference to FIG. 1, FIG. 3, FIG. 7, and FIGS. 9-10, the ratchet gear 910 is operably coupled with the at least one pawl member 912*a-n* to enable the power strip housing 102 to selectively rotate at least 360° and with the plurality of locked angular positions solely lockable in one direction of rotation. To effectuate the rotation of the power strip housing 102 relative to the rear plug support member 108, a circular housing recess 918 is defined by opposing inner walls 1000, 1002 of the power strip housing 102 and the rear surface 300 of the rear power strip housing 102 and the rear plug support member 108 is of a circular shape and disposed within the circular housing recess 918. The circular shape of the rear plug support member 108 contours a shape of the opposing inner walls 1000, 1002 of the power strip housing 102.

In one embodiment, the rear plug support member 108 also beneficially includes one or more retention flange member(s) 114 radially extending therefrom and defining a retention aperture 924 thereon and with a fastener 116 disposed therein. The fastener 116 is operably configured to be received therethrough the retention aperture 924. The retention flange member 114 may be disposed proximal (i.e., at or near, with 1 inch) to the rear surface 110 of the rear plug support member 108. The fastener 116 is configured to couple with the threading conventionally found in most junction boxes for electrical outlets, and beneficially prevents or inhibits detachment of the assembly 100 therefrom. The power strip housing 102 is operably configured to selectively rotate with respect to the rear plug support member 108 and have a rotation position along a housing rotation path (represented with arrows 200, 714 in FIG. 2 and FIG. 7, respectively) with the rear surface 300 of the power strip housing 102 in at least a partially overlapping and adjacent configuration with the retention flange member 114. Said differently, the retention flange member(s) 114 is of a thickness or is otherwise offset from the thickness of the inner walls defining the circular housing recess 918 to permit the power strip housing 102 to pass thereby without contacting the retention flange member(s) 114. Although one retention flange member 114 is depicted, another opposing retention flange member 114 may be utilized for coupling to a bottom threaded aperture in the junction box and through the plate cover of the wall outlet.

In one embodiment, the power strip housing 102 also includes a sidewall 118 surrounding and partially defining the housing cavity 902, wherein the sidewall 118 includes an LED strip 120 coupled thereto. The LED strip 120 beneficially spans at least 75% of the housing length 500, is longitudinally oriented, and is electrically connected to a driver and the electrical prongs 702, 704, 706, 708, 710, 712. The driver is operably configured to convert higher voltage, alternating current to low voltage, direct current, in addition to keeping the voltage and current flowing through the LED strip at its rated level. The electrical components, including USB ports accessible through the front surface 104 of the power strip housing 102, can be seen best in the exploded view of FIG. 9. The LED strip 120 beneficially enables the user to tell the orientation of the power strip housing 102 in low light environments, e.g., while studying at a desk, and at night. In preferred embodiments, the power strip housing 102 includes two LED strips on opposing sides of the housing 102.

Although a specific order of utilizing the assembly 100 has been described herein, the order of executing the steps may be changed relative to the order shown in certain embodiments. Also, two or more steps described or shown as occurring in succession may be executed concurrently or with partial concurrence in some embodiments. Certain steps may also be omitted herein for brevity. In some embodiments, some or all of the process steps described herein can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A rotatable power strip outlet assembly comprising:

a power strip housing with a rear surface, a front surface opposing the rear surface of the power strip housing, and encapsulating a housing cavity;

a plurality of electrical sockets formed on the front surface of the power strip housing and each at least partially disposed within the housing cavity; and a rear plug support member rotatably coupled to the power strip housing, having a front surface, having a rear surface opposing the front surface of the rear plug support member, and having an electrical plug disposed on the rear surface of the rear plug support member and with electrical prongs extending outwardly away from the rear surface of the rear plug support member and electrically coupled to the plurality of electrical sockets, the power strip housing operably configured to selectively rotate at least 270° with respect to the rear plug support member;

wherein the rear plug support member further comprises:

a retention flange member radially extending therefrom and defining a retention aperture thereon and with a fastener operably configured to be received therethrough, the retention flange member disposed proximal to the rear surface of the rear plug support member.

2. The rotatable power strip outlet assembly according to claim 1, further comprising:

a rear support spindle operably configured to couple the plug support member to the power strip housing; and an electrical connector defined by the power strip housing and axially aligned with the rear support spindle, the electrical connector operably configured to enable electrical coupling of the electrical prongs to the plurality of electrical sockets.

3. The rotatable power strip outlet assembly according to claim 2, wherein the electrical connector is a wire aperture and further comprising:

a plurality of electrical wires electrically coupling the electrical prongs to the plurality of electrical sockets and disposed within the wire aperture.

4. The rotatable power strip outlet assembly according to claim 3, further comprising:

a ratchet gear and pawl assembly operably coupled to the rear surface of the power strip housing and the rear surface of the rear plug support member, the ratchet gear and pawl assembly operably configured to enable the power strip housing to selectively rotate the at least 270° and in a plurality of locked angular positions with respect to the rear plug support member.

5. The rotatable power strip outlet assembly according to claim 4, further comprising:

a sidewall surrounding the rear surface of the rear plug support member and with an inner sidewall surface having at least one pawl member projecting therefrom; and a ratchet gear of the ratchet gear and pawl assembly coupled to the rear surface of the power strip housing and operably coupled with the at least one pawl member to enable the power strip housing to selectively rotate in the plurality of locked angular positions with respect to the rear plug support member.

6. The rotatable power strip outlet assembly according to claim 5, wherein:

the ratchet gear operably coupled with the at least one pawl member to enable the power strip housing to selectively rotate at least 360° and with the plurality of locked angular positions solely lockable in one direction of rotation.

7. The rotatable power strip outlet assembly according to claim 6, further comprising:

a circular housing recess defined by opposing inner walls of the power strip housing and the rear surface of the rear power strip housing; and the rear plug support member of a circular shape and disposed within the circular housing recess, the circular shape of the rear plug support member contouring a shape of the opposing inner walls of the power strip housing.

8. The rotatable power strip outlet assembly according to claim 7, wherein the power strip housing operably configured to selectively rotate with respect to the rear plug support member and have a rotation position along a housing rotation path with the rear surface of the power strip housing in at least a partially overlapping and adjacent configuration with the retention flange member.

9. The rotatable power strip outlet assembly according to claim 1, wherein the power strip housing further comprises:

a plurality of socket apertures independently defined thereon and each having one of a plurality of socket housings disposed therein, the plurality of socket housings:

each at least partially disposed within the housing cavity;

each retained on the power strip housing with at least one spring-loaded clip; and defining the plurality of electrical sockets formed on the front surface of the power strip housing.

10. The rotatable power strip outlet assembly according to claim 9, wherein:

the plurality of socket housings are each coupled to the power strip housing in a tongue-and-groove configuration on two opposing sides of the plurality of socket housings.

11. The rotatable power strip outlet assembly according to claim 1, wherein the power strip housing further comprises:

a first end, a second end opposing the first end of the power strip housing, a housing length separating the first and second ends of the power strip housing, and a sidewall surrounding the housing cavity and including an LED strip coupled thereto, spanning at least 75% of the housing length, longitudinally oriented, and electrically connected to a driver and the electrical prongs.

12. A rotatable power strip outlet assembly comprising:

a power strip housing with a rear surface, a front surface opposing the rear surface of the power strip housing, and defining a housing cavity;

a plurality of electrical sockets formed on the front surface of the power strip housing and each at least partially disposed within the housing cavity;

a rear plug support member rotatably coupled to the power strip housing, having a front surface having a rear surface opposing the front surface of the rear plug support member, and having an electrical plug disposed on the rear surface of the rear plug support member and with electrical prongs extending outwardly away from the rear surface of the rear plug support member and electrically coupled to the plurality of electrical sockets; and a ratchet gear and pawl assembly operably coupled to the rear surface of the power strip housing and the rear surface of the rear plug support member, the ratchet gear and pawl assembly operably configured to enable the power strip housing to selectively rotate at least 270° and in a plurality of locked angular positions with respect to the rear plug support member.

13. The rotatable power strip outlet assembly according to claim 12, further comprising:

a rear support spindle operably configured to couple the plug support member to the power strip housing; and an electrical connector defined by the power strip housing and axially aligned with the rear support spindle, the electrical connector operably configured to enable electrical coupling of the electrical prongs to the plurality of electrical sockets.

14. The rotatable power strip outlet assembly according to claim 13, wherein the electrical connector is a wire aperture and further comprising:

a plurality of electrical wires electrically coupling the electrical prongs to the plurality of electrical sockets and disposed within the wire aperture.

15. The rotatable power strip outlet assembly according to claim 12, further comprising:

a sidewall surrounding the rear surface of the rear plug support member and with an inner sidewall surface having at least one pawl member projecting therefrom; and a ratchet gear of the ratchet gear and pawl assembly coupled to the rear surface of the power strip housing and operably coupled with the at least one pawl member to enable the power strip housing to selectively rotate in the plurality of locked angular positions with respect to the rear plug support member.

16. The rotatable power strip outlet assembly according to claim 15, wherein:

the ratchet gear operably coupled with the at least one pawl member to enable the power strip housing to selectively rotate at least 360° and with the plurality of locked angular positions solely lockable in one direction of rotation.

17. The rotatable power strip outlet assembly according to claim 16, further comprising:

a circular housing recess defined by opposing inner walls of the power strip housing and the rear surface of the rear power strip housing; and the rear plug support member of a circular shape and disposed within the circular housing recess, the circular shape of the rear plug support member contouring a shape of the opposing inner walls of the power strip housing.

18. The rotatable power strip outlet assembly according to claim 17, wherein the rear plug support member further comprises:

a retention flange member radially extending therefrom and defining a retention aperture thereon and with a fastener operably configured to be received therethrough, the retention flange member disposed proximal to the rear surface of the rear plug support member, wherein the power strip housing operably configured to selectively rotate with respect to the rear plug support member and have a rotation position along a housing rotation path with the rear surface of the power strip housing in at least a partially overlapping and adjacent configuration with the retention flange member.

19. The rotatable power strip outlet assembly according to claim 1, wherein the power strip housing further comprises:

a plurality of socket apertures independently defined thereon and each having one of a plurality of socket housings disposed therein, the plurality of socket housings:

each at least partially disposed within the housing cavity;

each retained on the power strip housing with at least one spring-loaded clip; and forming the plurality of electrical sockets formed on the front surface of the power strip housing.

* * * * *